United States Patent [19]

Jaffa

[11] 4,407,195

[45] Oct. 4, 1983

[54] SCREEN PRINTING MACHINE

[75] Inventor: David Jaffa, Franklin Lakes, N.J.

[73] Assignee: Precision Screen Machines, Inc., Hawthorne, N.J.

[21] Appl. No.: 176,067

[22] Filed: Aug. 7, 1980

[51] Int. Cl.[3] ..... B41F 15/10

[52] U.S. Cl. ..... 101/123; 101/126

[58] Field of Search ..... 101/123, 126; 198/793, 198/797

[56] References Cited

U.S. PATENT DOCUMENTS

| | | | |
|---|---|---|---|
| 2,789,686 | 4/1957 | Bonnafe | 198/793 |
| 3,795,189 | 3/1974 | Jaffa | 101/123 |
| 3,838,639 | 10/1974 | Harwell | 101/123 |
| 3,842,733 | 10/1974 | Dubuit | 101/126 X |
| 4,031,825 | 6/1977 | Jaffa | 101/126 |
| 4,084,504 | 4/1978 | Fuchs | 101/126 X |

*Primary Examiner*—A. J. Heinz

*Attorney, Agent, or Firm*—Weingram & Klauber

[57] ABSTRACT

In a screen printing machine having a plurality of workpiece supporting pallets that are driven along an oval path and which cooperate with a plurality of printing heads that are adapted for movement between an operative, printing position at each of a plurality of printing stations and an inoperative, non-printing position spaced from each of the printing stations, means are provided for selectively indexing the pallets either to an immediate printing station or to a succeeding printing station which is spaced downstream from the preceding printing station in the direction of movement of the pallets by at least one intermediate printing station. The apparatus disclosed herein replaced the hydraulic and electrical apparatus of the prior art with mechanical structure and requires only a single operator as compared with two or three operators with prior art structure. A cable is used in the present invention to replace the power linkage employed in the prior art for raising and lowering the flood bar.

8 Claims, 19 Drawing Figures

5
5
6
6
24
46
30
48
66
20
12H
12A
80
66
118
128
118
66
50
106
32
52
60
88
82
89
86
90
116
92
114
144
54
58
96
112
98
150
110
106
100
102
18
104

24
116
48
32
28
106
60
128
7
7
150
114
148
96
98
154
110
112
146
144
58
134
138
156
158
160
162
166
164
135
142
100
104
102
106
128

158
135
142
156
138
134
58
144
116
146
148
112
8
8
154
32
110
96
172
176
186
10
10
184
9
9
174
178
180
182
170
150
60

182
184
180
60
178
174
150
170

148
172
170
178
96
176
186

58
116
144
146
148

SCREEN PRINTING MACHINE

BACKGROUND OF THE INVENTION

This invention relates generally to screen printing machines and more particularly to an improved, mechanically actuated screen printing machine that is lower in cost and which requires fewer operators than the prior art machines.

DESCRIPTION OF THE PRIOR ART

My issued U.S. Pat. No. 3,795,189 which was granted on Mar. 5, 1974 discloses a screen printing machine having an oval rail for indexing pallets in a single plane. The pallets and the workpieces supported thereon are indexed from station to station. Pallet base plates provide support for the pallets which may be disengaged from time to time from the base plates, as required. Accurate registration of the pallet base plate is achieved by a locating bar which engages a notch in the pallet base plate when the base plate is stationary and has been indexed to a working station where a printing head assembly is disposed in an operatively associated position for movement into and out of printing relationship with the workpiece supported on the pallet. The quality of the screen printing process is dependent upon the accurate registration of the removable pallet with the base plate which supports it.

In my aforementioned issued U.S. patent, the substantially rectangularly base plate portion of the screen printing machine provides support for the pallet while accurately locating and constraining the pallet in the fixed, operable location thereupon. A notch is provided in a reduced end portion of a base plate which is available to the base plate locking mechanism so that the pallet is effectively detented to the base plate without modification or interference with the reduced end portion thereof.

Referring still to my issued U.S. Pat. No. 3,795,189 a portion thereof to which the present invention can be compared relates to a squeegee carriage supported on a printing head frame which is pivoted to the inoperative position at the end of the printing stroke. A flood blade is allowed to assume an operative position through the movement of the printing head frame. Specifically, rollers are provided for maintaining contact with a screen holder. When the printing head frame moves into the inoperative position, the rollers extend away from the printing head to which they are attached. Thus, the rollers position the flood blades for the flood stroke.

Also disclosed in my U.S. Pat. No. 3,795,189 is an indexing means which controls the intermittent movement of the respective pallets from station to station during operation. The indexing means comprise a ram stop lever which is selectively positioned by a piston and cylinder assembly in order to engage or disengage a cam stop follower that is connected to the drive which moves the pallet. The piston and cylinder assembly is synchronized with the printing head frame and pallet drive using electrical and hydraulic elements to form an operable screen printing machine.

In a second example of the prior art, my issued U.S. Pat. No. 4,031,825 granted on June 28, 1977, there is disclosed an improved apparatus for mounting the pallets on the screen printing machine. This second form of prior art utilizes two opposed, longitudinal marginal edges of the generally rectangularly shaped base plate in order to detent the pallet to the base plate and to prevent any side-to-side lateral displacement of the pallet in a direction transverse to the longitudinal axis of the base plate.

In the second of the two U.S. patents mentioned above, a pair of cam-like fingers are installed on one marginal edge of the base plate. The base plate has two parallel adjacent surfaces that are arranged for engagement with an innermost vertical surface of a side rail that is disposed downwardly from the lower most planar surface of the pallet. One of the two aforesaid fingers is biased outwardly in the vicinity of a V-shaped portion of its surface which is adapted to engage a complimentary, oppositely directed V-shaped notch in the adjacent, vertical surface of the pallet side rail. The other of the two cam-like fingers has a similarly outwardly directed portion which is V-shaped and which is restrained from unlimited displacement inwardly towards the center of the supporting plate, thereby providing a controlled resistive outwardly directed force against the surface of the side rail. The combined action of both cam-like fingers results in detenting and locking another side rail in touching engagement with the opposite longitudinal edge of the pallet supporting base plate.

My two aforementioned issued U.S. Pat. No. 3,795,189 issued on Mar. 5, 1974 and U.S. Pat. No. 4,031,825 issued on June 28, 1977 are incorporated herein by reference.

Still another example of the prior art, in the general field to which the present application is directed, is disclosed in my co-pending application, Ser. No. 369,402, filed Apr. 19, 1982, which is a continuation of my application Ser. No. 58,102 filed July 16, 1979, now abandoned and which is also incorporated herein by reference. My co-pending application is particularly directed to an improved workpiece supporting pallet, as well as means for locating and guiding the pallet, in a screen printing machine having an oval or other predetermined geometrical configuration track about which a series of the pallets are indexed from station to station. The improved pallet disclosed in my co-pending application includes a fibrous core, a metallic sheath enclosing the core, a pallet disposed upon the upper surface of at least a portion of the sheath and a protective layer covering the pallet. A tacky film layer is disposed over the protective layer. Of particular interest, is the means for attaching the pallet assemblies to a motor driven endless chain in the screen printing machine.

The pallet assembly construction is achieved by means of two hollow bushings that are adapted to receive the link connecting pins of the endless chains. One of the two bushings is adjustably positioned in order to compensate for the reduction of the linear dimension between the conveyor chain pins as the links which are coupled to the pallet support assembly traverse arcuate paths about the drive and idler sprockets. In one embodiment of the invention disclosed, in my co-pending application, the pallet guidance means are low friction, elongated rails that slidably engage the upper and lower surface of the pallet assembly. In an alternative embodiment of the structure disclosed in said co-pending application, the guidance means are in the form of rollers that are rotatably coupled to the pallet assembly and which are engaged by fixedly positioned rails.

SUMMARY OF THE INVENTION

The present invention is particularly directed to indexing apparatus, for example double indexing, which is basically mechanical and which is of simple construction for the purpose of reducing manufacturing costs. Thus, the present invention can serve to replace the hydraulic and electrical apparatus of the prior art with mechanical devices. In the present invention, only one operator is required as compared to either two or three operators, as is the existent situation with prior art structure. Specifically, the power linkage employed in the prior art structure for raising and lowering the flood bar is replaced in the present invention by a cable. In addition, the present invention is adapted to run at a single rate of speed.

The present invention provides a clutch for raising the printing head assembly which is then held in its upper position by a brake which is activated when the printing head is lowered so that the printing head cannot lift upwardly when squeegee pressure is applied. Engagement of the clutch permits the printing head to be raised, and disengages the brake. To lower the printing head, the clutch is engaged once again to control the motion of the printing head and then the brake is disengaged. When the printing head is completely down, the clutch is disengaged and the brake is engaged.

Accordingly, it is the primary object of the present invention to provide an improved screen printing machine.

Another object of the invention is to provide an improved screen printing machine wherein the squeegee and flood blade actuating mechanisms are basically mechanical.

Still another object of the present invention is to provide an improved screen printing machine, as described above, that is more reliable in operation than presently existing machines.

It is still a further object of the present invention to provide an improved screen printing machine, as described above, which is lower in cost than presently available machines.

It is yet another object of the present invention to provide an improved screen printing machine, as described above, wherein the mechanism for controlling the movement of the pallets can be quickly and easily adjusted for either single station indexing or for multiple station indexing.

It is another object of the present invention to provide an improved screen printing machine, as described above, wherein only a single operator is required.

A further object of the present invention is to provide an improved screen printing machine, as described above, which moves at a single rate of speed.

It is a more specific object of the present invention to provide an improved screen printing machine, as described above, which utilizes cables for lifting and lowering the flood assembly, and not parallel linkages as employed in the prior art structures.

BRIEF DESCRIPTION OF THE DRAWINGS

The foregoing and other objects, features and advantages of the present invention will become more apparent from the detailed description hereinafter when considered in conjunction with the accompanying drawings, wherein.

DETAILED DESCRIPTION OF THE PREFERRED EMBODIMENTS

Figure 1:
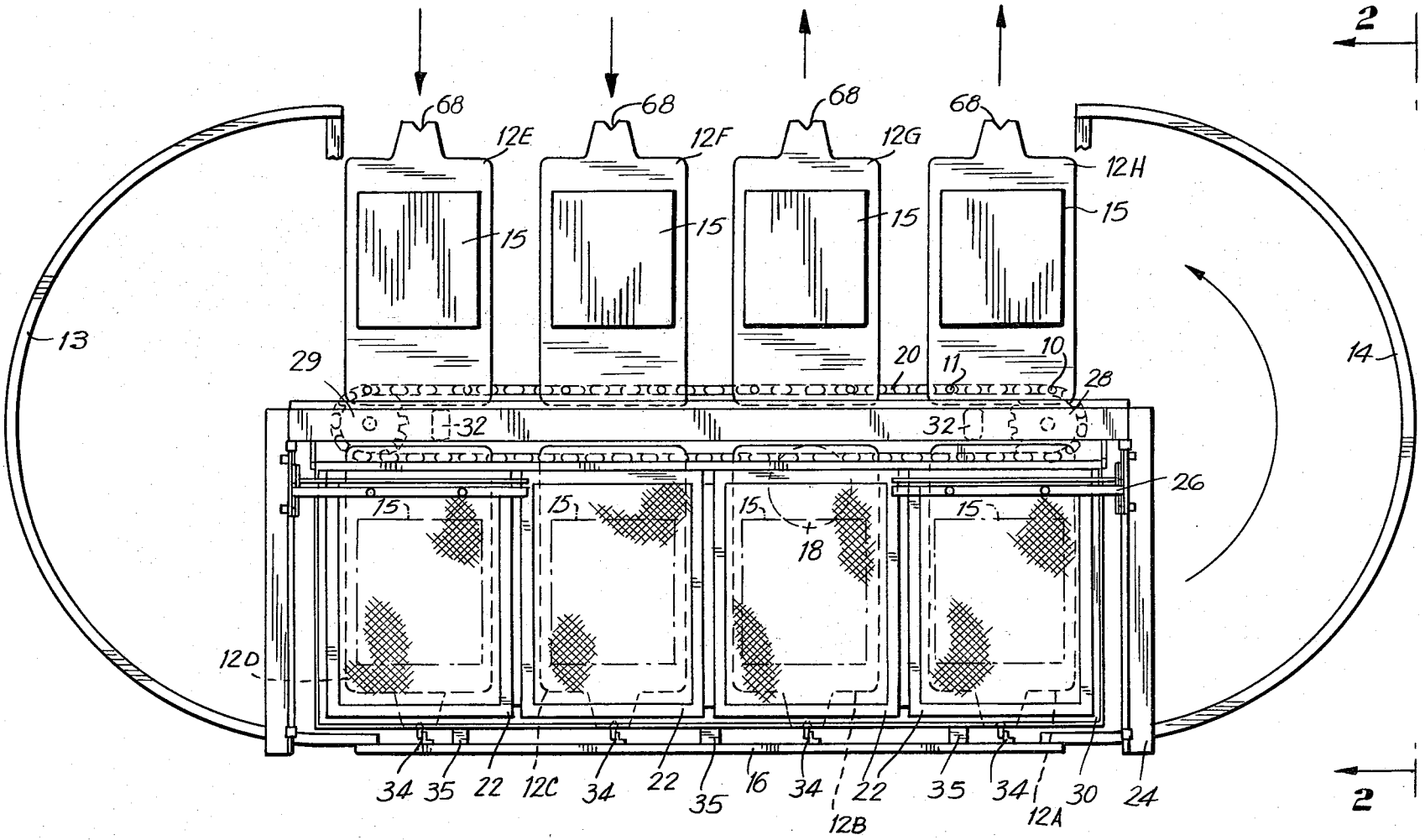
FIG. 1 is a plan view of the improved screen printing machine comprising the present invention.

Referring first to FIG. 1, there is shown an improved screen printing machine having a plurality of pallet assemblies 12 which are coupled to an endless chain 20 in order to be driven thereby along an oval path. The pallet assemblies 12 are secured to the endless chain 20 by means of chain link pins 10 and 11. One of the pins 11 is engaged within a closely fitting hole in each pallet assembly 12 while the pin 10 is engaged within an elongated slot in each of the respective pallet assemblies 12. The construction, function and purpose of the structure is treated in more detail in my co-pending patent application Ser. No. 369,402, filed Apr. 15, 1982, which is a continuation of application Ser. No. 58,102, filed July 16, 1979 and referred to hereinabove. During their travel along the oval path, the end of the pallet assemblies 12 which are remote from the pins 10 and 11, are enclosed by a first rail portion 13 that is arcuate in shape and which is located at one end of the apparatus, then on an intermediate rail portion 16 which is linear in shape and which is contiguous with one end of the arcuate first portion 13, are again enclosed by a second arcuate portion 14, one end of which is contiguous with the end of the intermediate portion 16 that is remote from the first arcuate portion 13. The rail portions 13 and 14 prevent injury to persons in proximity of the moving pallet assemblies 12. The endless chain is trained about first and second sprockets 28 and 29 with a motor 18 being used to drive the first sprocket 28. A second base frame assembly 32 supports the improved screen printing machine when the same is operational.

The motor 18 is secured to the second base frame assembly 32 as are a first head assembly 24, a second head assembly 26, and a screen holder assembly 30. A plurality of printing screens 22 are suitably supported, in a well known manner, within the screen holder assemblies 30 and a work support 15 is positioned between each printing screen and its respective pallet assembly 12. Each of the work supports 15 is detachably secured to its respective pallet assembly 12 and each of the pallet assemblies 12 which is disposed under a respective printing screen 22 is aligned for accurate printing registration by means of a pallet locater assembly 34 which is described more fully in my aforementioned, co-pending patent application.

Figure 2:
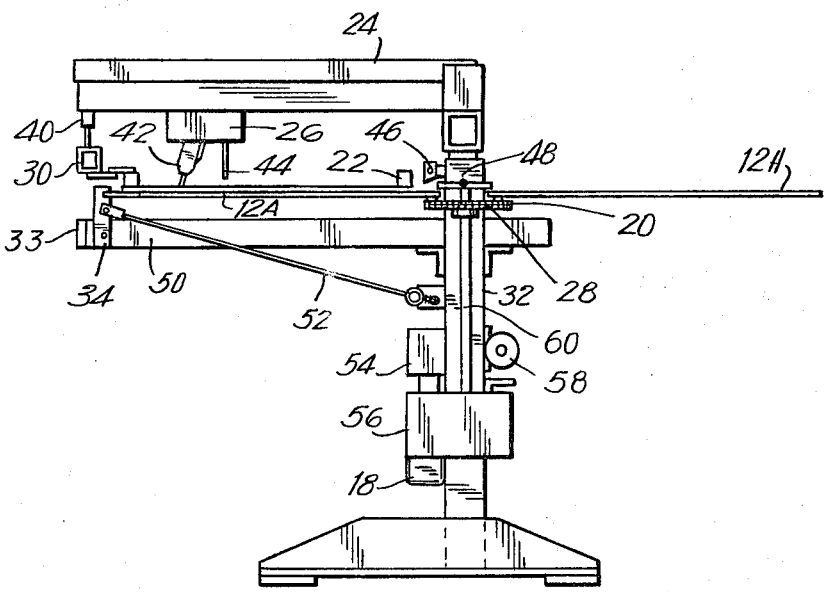
FIG. 2 is an end elevational view taken along line 2—2 of FIG. 1 with portions removed for purposes of clarity.

In FIG. 2 there is shown the second base frame assembly 32 that is connected to the first head assembly 24 by means of a pair of primary pivot pins 48. The first sprocket 28 is rigidly mounted on a first drive shaft 60 which is driven by means of an indexing assembly 56, in turn, driven by the motor 18. As will be pointed out more fully hereinafter, the motor 18 is coupled to a first gear box 54 (FIG. 4) which powers a lift and lower shaft assembly 58 that causes the first head assembly 24 to rotate about the pair of primary pivot pins 48 in a predetermined manner.

As seen in FIG. 2, when the first head assembly 24 is raised to the "out of printing" position, the screen holder assembly 30 is also pivoted about screen pivot pins 46 by means of a pair of adjustsble drag links 40. The printing screens 22 are detachably secured to the screen holder assembly and immediately thereunder are positioned the pallet assemblies 12. When the first head assembly 24 is lowered into printing position, the pallet assemblies 12 which are under the printing screen 22 are locked into position by a plurality of pull rod assemblies 52 that coact with the plurality of respective screen holders locater assemblies 34 in order to lock and unlock the aforementioned pallet assemblies 12. The base frame members 50 extend horizontally from the second base frame assembly 32 and have the first base frame member 33 secured to their ends. The plurality of screen holder locater assemblies 34 are also secured to the first base frame member 33. As also shown in FIG. 2, a squeegee assembly 42 and a flood blade 44 are also secured to the printing carriage assembly 26. In practice, there would of course be a plurality of squeegee assemblies 42 and a plurality of the flood blades 44.

Figure 3:
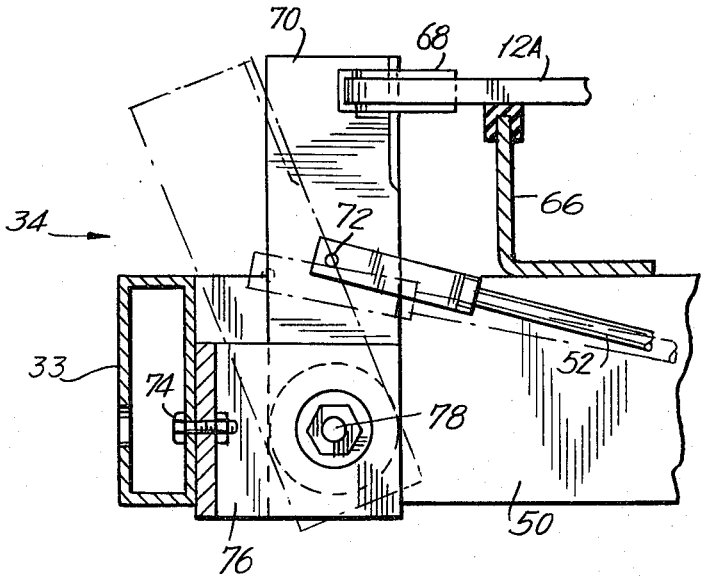
FIG. 3 is a fragmentary elevational view, partially in section and on an enlarged scale, illustrating a portion of the structure depicted in FIG. 1 in two alternative positions.

Referring now to FIG. 3, it will be seen that the pallet assembly 12A is supported by a rail assembly 66 which is secured to the first base frame member 33. The pallet assembly 12A is provided with a notch 68 as shown in FIG. 1 into which a locater block 70 projects. It will be appreciated that the locater block 70 is biased by means of the pull rod assembly 52 in order to be disposed within the reinforced notch 68 when in the locked position. A pull rod assembly 52 is privotally secured to the locater block 70 by means of a pivot pin 72 and the locator block 70 is movable from the solid outline position, which is the locked position, to the dotted outline position, which is the unlocked position, by rotating about a pivot assembly 78 which is secured to the first base frame member 33 by means of a support member 76 and a fastener 77.

Figure 4:
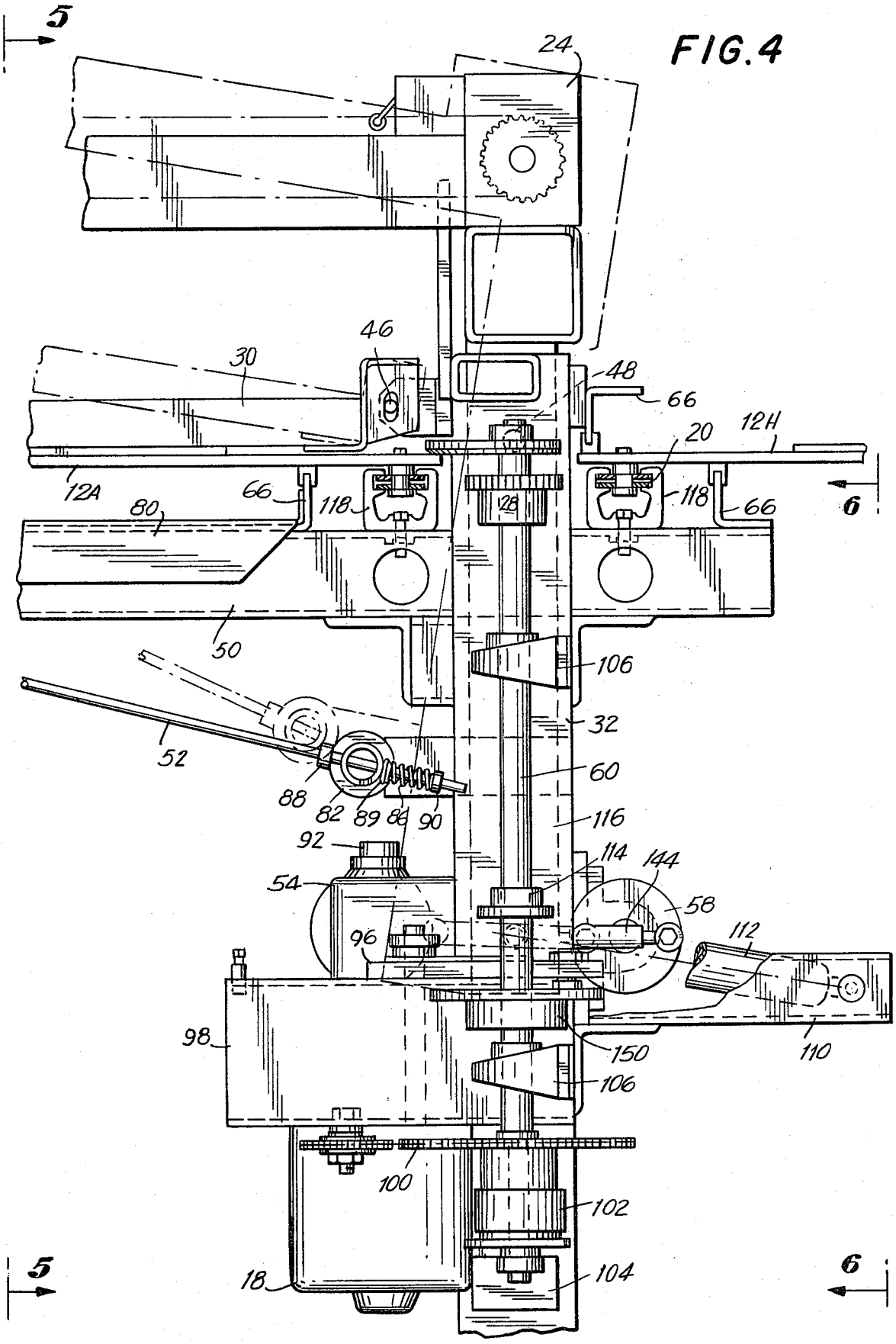
FIG. 4 is a fragmentary elevational view similar in orientation to FIG. 2 but on an enlarged scale and partially broken away illustrating selected components in two alternative positions.

Referring now to FIG. 4, the first head assembly 24 is shown as including a pair of downwardly depending members 116 which also rotate about the primary pivot pins 48. The members 116 have a first pair of adjustable links 144 at the lower end thereof for attachment to the lift and lower shaft assembly 58. A predetermined angular displacement of the lift and lower shaft assembly 58 causes the members 116 to raise and lower the first head assembly 24. Each member 116 is pivotally attached to a hydraulic damper 112 which is, in turn, pivotally attached to a damper support 110 that is secured to the second base frame assembly 32.

Figure 5:
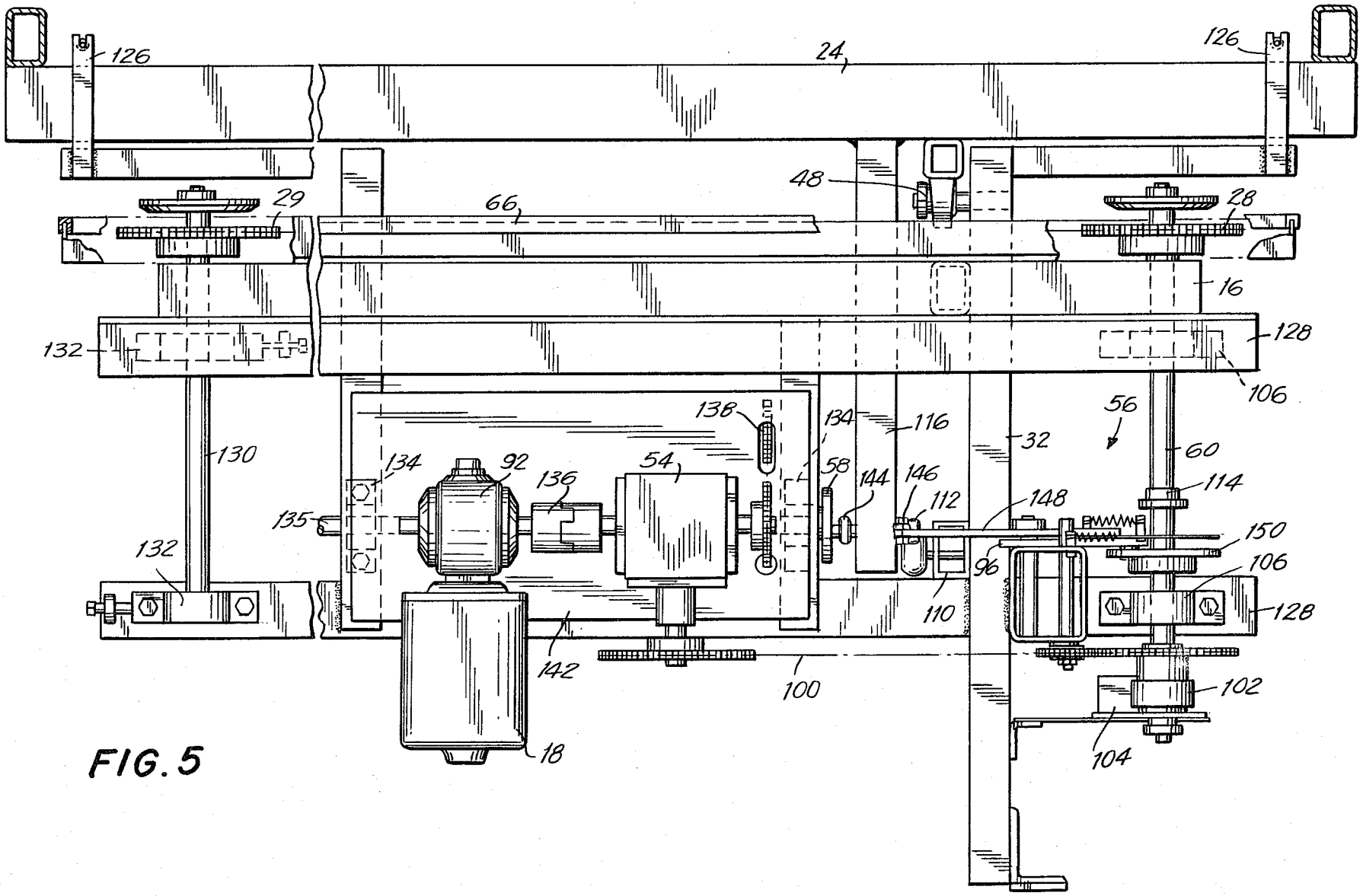
FIG. 5 is a fragmentary sectional elevational view, partially in section, taken along line 5—5 of FIG. 4 with portions thereof broken away.

The motor 18 is drivingly coupled to the first gear box 54 by means of a coupling 136 (as shown in FIG. 5) and a right angle gear drive 92. The first gear box 54 provides power for the lift and lower shaft assembly 58 and for a first chain drive assembly 100 that drives the first drive shaft 60 which is supported by a pair of pillow blocks 106. A slip clutch 102, which is secured to a restraining bracket 104, is rigidly mounted on the first drive shaft 60. The restraining bracket 104 is secured to the second base frame assembly 32. Also mounted on the first drive shaft 60 is a ram stop cam 150 positioned directly above the lower one of the two pillow blocks 106. The ram stop cam 150 coacts with a ram stop lever 96 that is pivotally secured to a ram stop support 98 which is mounted on the second base frame assembly 32. A multiple index sprocket 114 is also mounted on the first drive shaft 60 directly above the ram stop assembly 98.

A tube 82 is secured to the pair of downwardly depending members 116 in order to coact with the plurality of pull out assemblies 52 for locking and unlocking the pallet locater assemblies 34. The pull rod assemblies 52 (FIG. 4) provide a biasing force on their respective screen holder locator assemblies 34 (FIG. 2) by means of a compression spring 86, a first collar 88, a washer 89 and a second collar 90. This construction assures that the biasing force remains at a preset value.

As shown in FIG. 4, the pallet assemblies 12A and 12H are in slidable contact with rail assemblies 66. The pallet assemblies 12A and 12H are also secured to the endless chain 20 that is guided by a pair of chain guide assemblies 118 which, together with a drag pan guard 80 are secured to the second base frame member 50.

Turning now to FIG. 5 it will be seen that the second base frame assembly 32 has secured thereto a pair of fixed cable link supports 126 and a pair of horizontal base frame members 128. An idler shaft 130 is supported by a pair of adjustable bearings 132 which are secured to the horizontal base frame members 128. FIG. 5 illustrates that, in addition to providing the driving force for the chain 100, the first gear box 54 also drives a second chain drive assembly 138. The first gear box 54 and the right angle gear drive 92 are mounted on a support plate 142 which is secured to the horizontal base frame members 128.

Figure 6:
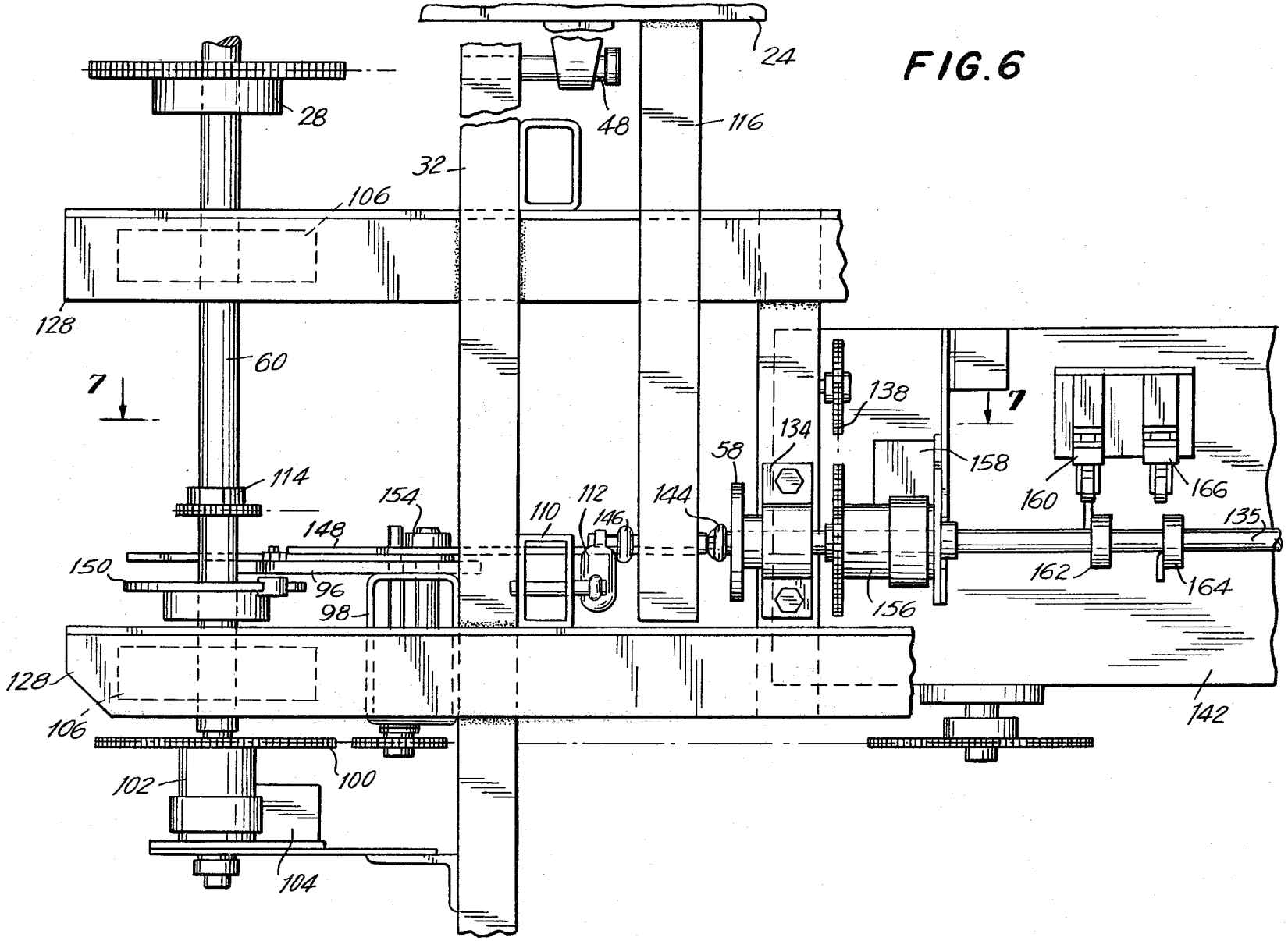
FIG. 6 is a fragmentary elevational view taken along line 6—6 of FIG. 4 with selected components removed for purposes of clarity.

A first pair of adjustable links 144, which are pivotally secured at each end of the members 116, cause the lift and lower shaft assembly 58 to coact with said members 116. A second adjustable link 146, which is pivotally mounted at each end of the members 116, causes a ram stop link assembly 148 to coact with one of the members 116. The ram stop cam 150 is mounted on the first drive shaft 60 for rotation therewith. The lift and lower shaft assembly 58 includes a lift and lower shaft 135 that is supported by a pair of bearings 134 in order to insure that the members 116 act as a single unit. As shown in FIG. 6, a stop clutch 156 is mounted on the lift and lower shaft 135. The stop clutch 156 is secured to a stop clutch support plate 158 that is mounted on a support plate 142 to which is also secured first and second limit switches 160 and 166, respectively. First and second cams 162 and 164, respectively, are rigidly secured to the shaft 135 for rotation together therewith in order to be able to engage their respective limit switches 160 and 166. In addition, a ram stop pivot 154 is secured to a ram stop support 98.

Figure 7:
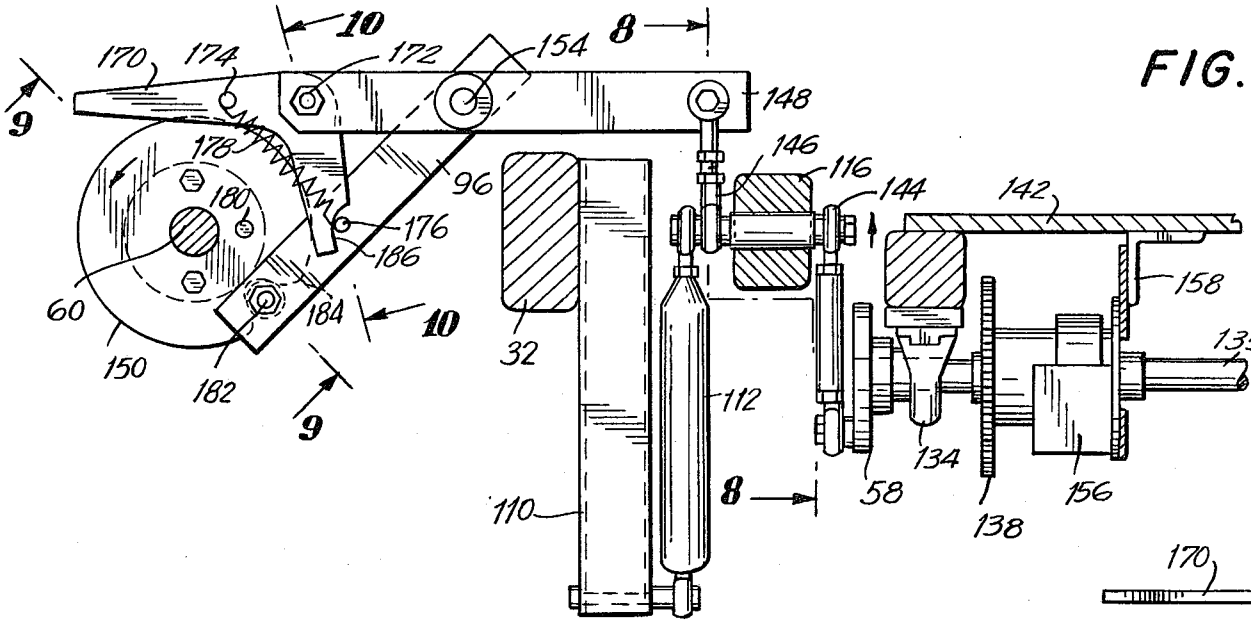
FIG. 7 is a fragmentary sectional plan view, partially in section, taken along line 7—7 of FIG. 6.
Figure 9:
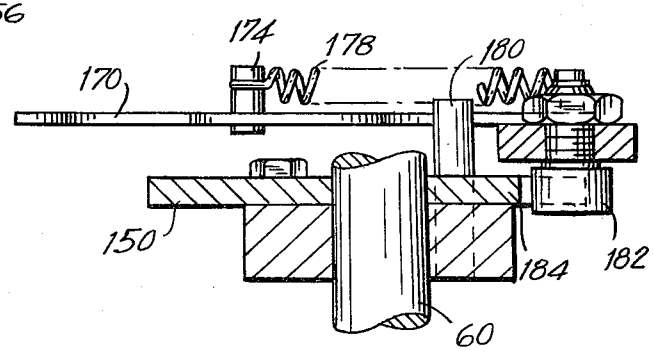
FIG. 9 is a fragmentary sectional elevational view, partially in section, taken along line 9—9 of FIG. 7.
Figure 10:
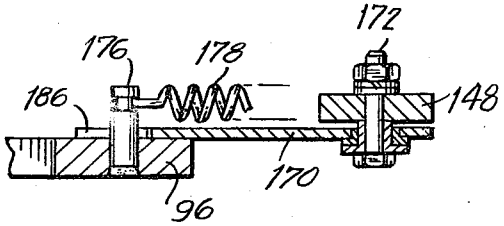
FIG. 10 is a fragmentary sectional elevational view, partially in section, taken along line 10—10 of FIG. 7.
Figure 8:
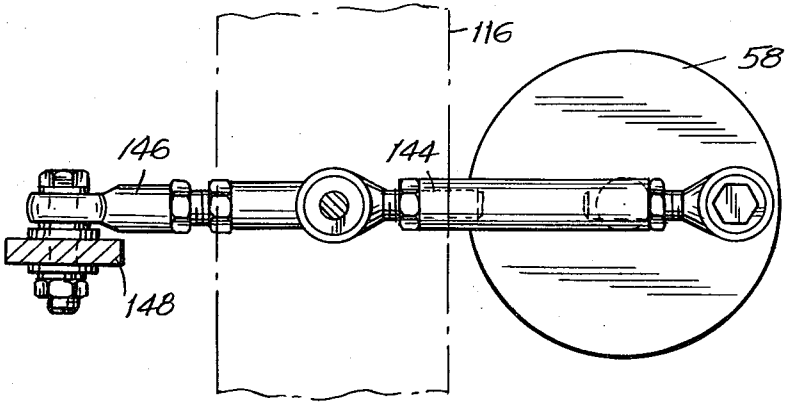
FIG. 8 is a fragmentary sectional elevational view, partially in section, taken along line 8—8 of FIG. 7.

The single indexing mechanism comprising the present invention may best be seen in FIG. 7. As shown therein, a bell crank-shaped ram stop arm 170 is secured to a ram stop link assembly 148 by means of a ram stop pivot pin 172. Further, the ram stop arm 170 is provided with a cutout 186 at one end of one of the arms thereof. A first anchor pin 174 is secured to the other arm of the bell crank-shaped ram stop arm 170. The ram stop link assembly 148 and the ram stop lever 96 rotate about the ram stop pivot 154 which is in the ram stop link assembly 148. The ram stop lever 96 has a second anchor pin 176 secured thereto and a roller assembly 182 mounted thereon.

A first extension spring 178 extends between the first anchor pin 174 and the second anchor pin 176. The roller assembly 182, as shown in FIG. 7, is positioned during one portion of the cycle of operation, in a recess 184 formed on the periphery of the ram stop cam 150. A first ram stop pin 180 is secured to the ram stop cam 150 for a purpose to be described in more detail hereinafter.

Figure 11:
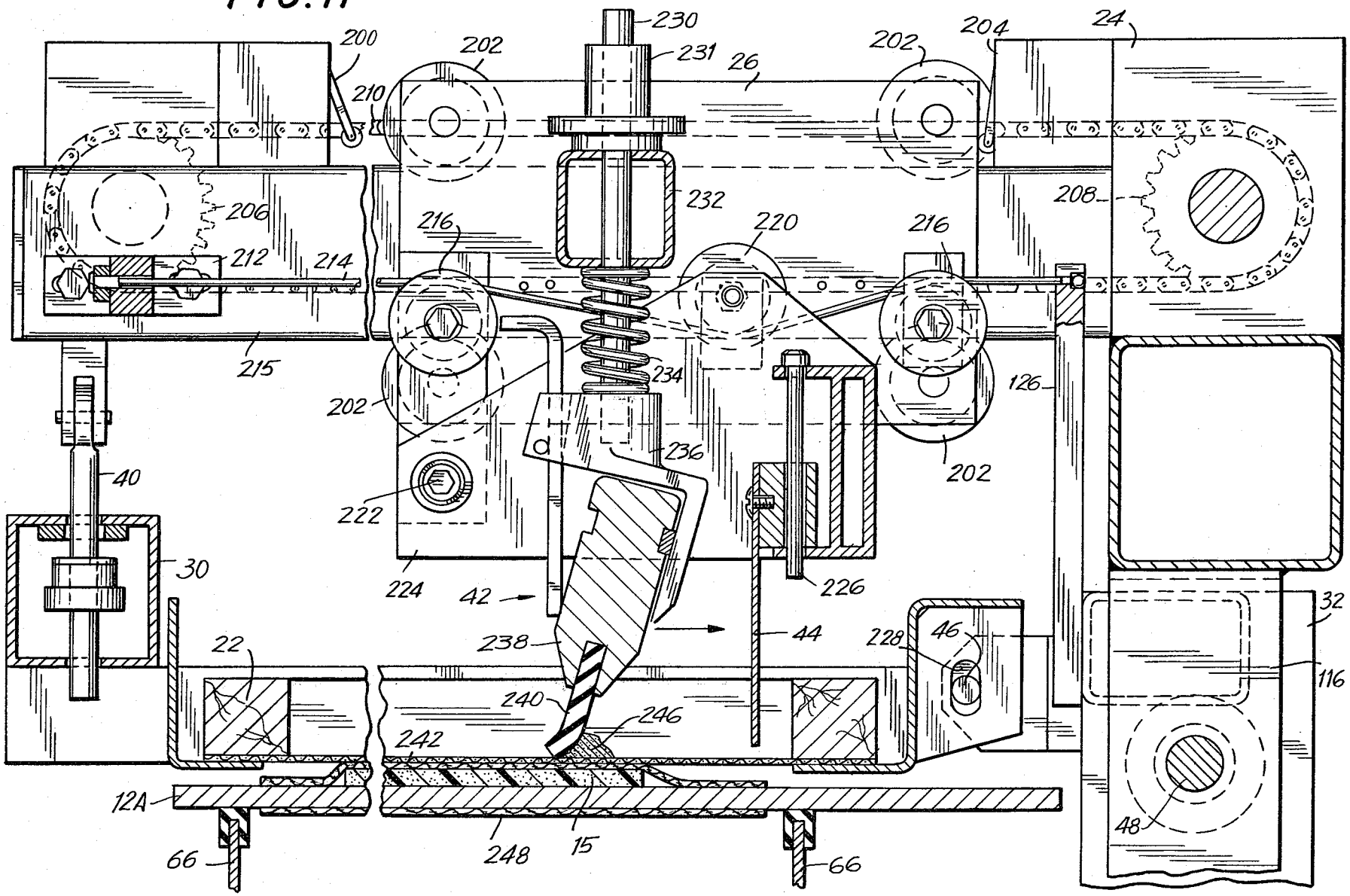
FIG. 11 is an enlarged elevational view, partially in section, illustrating the squeegee and flood blades as well as the actuating mechanism therefor in a first position.

Referring now to FIG. 11, there is shown a pair of horizontal rail members 215 that form part of the first head assembly 24. Slidably secured to one of the rail members 215 is a third limit switch 200 and a fourth limit switch 204. The second head assembly 26 is arranged to slidably traverse the rail members 215 and are maintained in alignment by means of guide rolls 202. A plurality of pulleys 216 are secured to the second head assembly 26 as is a flood blade support assembly 224 which is mounted on a pivot pin 222.

Secured to the flood blade support assembly 224 are a pair of intermediate pulleys 220 about which a pair of link cables 214 are trained. The link cables 214 also control the position of the flood blade support assembly 224 and are secured at one end to the respective pair of fixed cable link supports 126. The other end of the pair of link cables 214 are secured to a pair of adjustable cable link supports 212. A support bar 232 is secured to the second head assembly 26 for the purpose of providing a removable mounting arrangement for a plurality of adjusting studs 230. Each of the adjusting studs 230 is provided with an adjusting nut 231, a compression spring 234 and a squeegee holder 236 which comprises one of a plurality of the squeegee assemblies 42, such as shown in FIG. 2. The squeegee holder 236 has squeegees 238 secured thereto with each squeegee 238 including a flexible blade 240.

A plurality of flood blades 44, one of which is shown in FIG. 11, are adjustably secured to the flood blade support assembly by means of a pin 226 that slidably passes through a support block for the flood blade 44. The entire second head assemly 26 is caused to move along the horizontal rail members 215 by a pair of sprocket chains 210 having their ends secured to the second head assembly 26. Each of the sprocket chains 210 is trained about a drive sprocket 208 and an idler sprocket 206.

As shown best in the lower portion of FIG. 11, there is a screen surface 242 which comprises a part of each of the printing screens 22. On the top of each screen surface 242 is a predetermined volume of an ink-like substance 246. Immediately below the screen surface 242 and in contact with it is a textile workpiece 248 which encases portions of the pallet assemblies 12 and the raised portions 15. Also shown in FIG. 11, is a pair of screen pivot slots 228 in which are positioned the pair of screen pivot pins 46.

Figure 13:
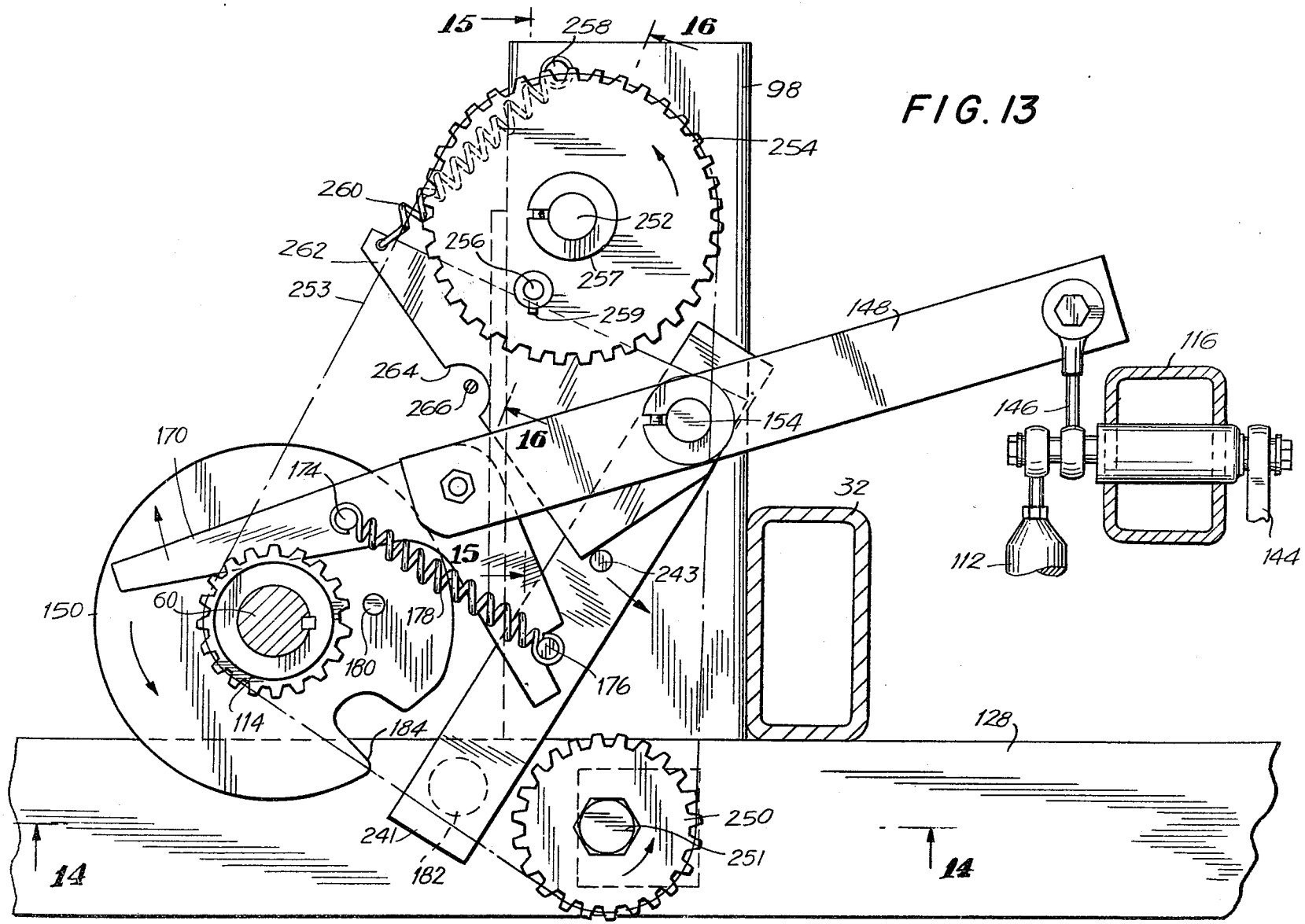
FIG. 13 is an enlarged fragmentary plan view, partially in section, illustrating an alternative embodiment of the structure shown in FIG. 7.
Figure 14:
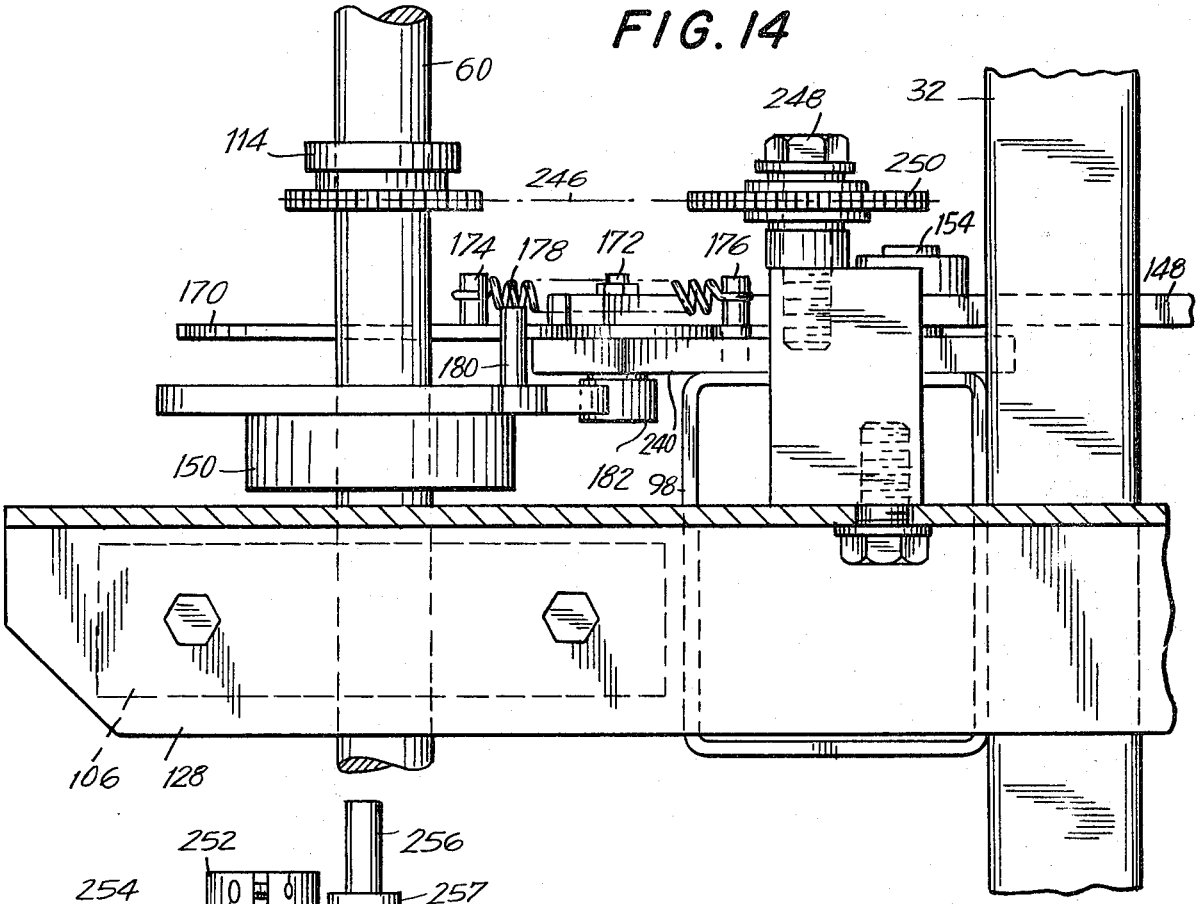
FIG. 14 is a fragmentary elevational view, on an enlarged scale, taken along line 14—14 of FIG. 13.
Figure 15:
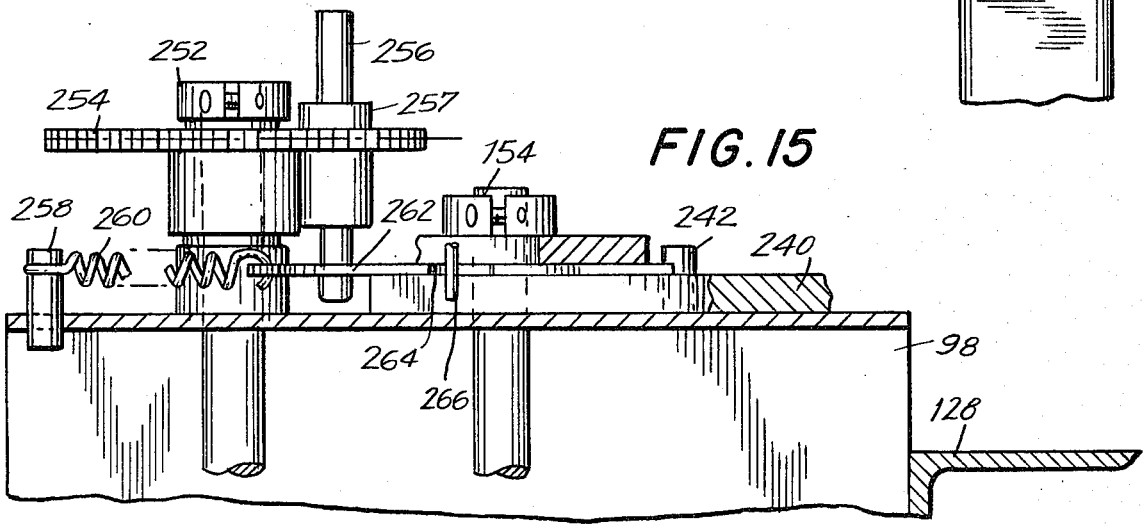
FIG. 15 is another enlarged, fragmentary elevational view, in section, taken along line 15—15 of FIG. 13.
Figure 16:
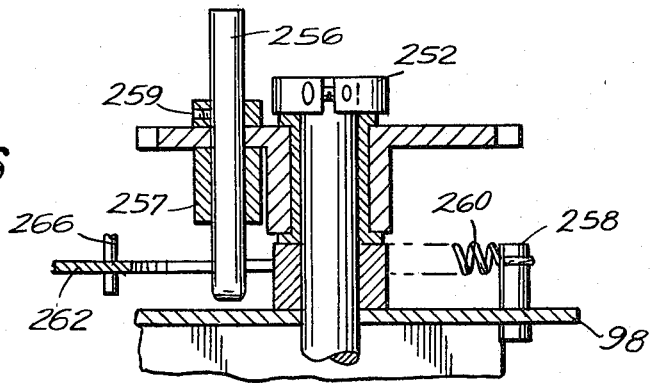
FIG. 16 is still another enlarged, fragmentary sectional elevational view taken along line 16—16 of FIG. 13.
Figure 18:
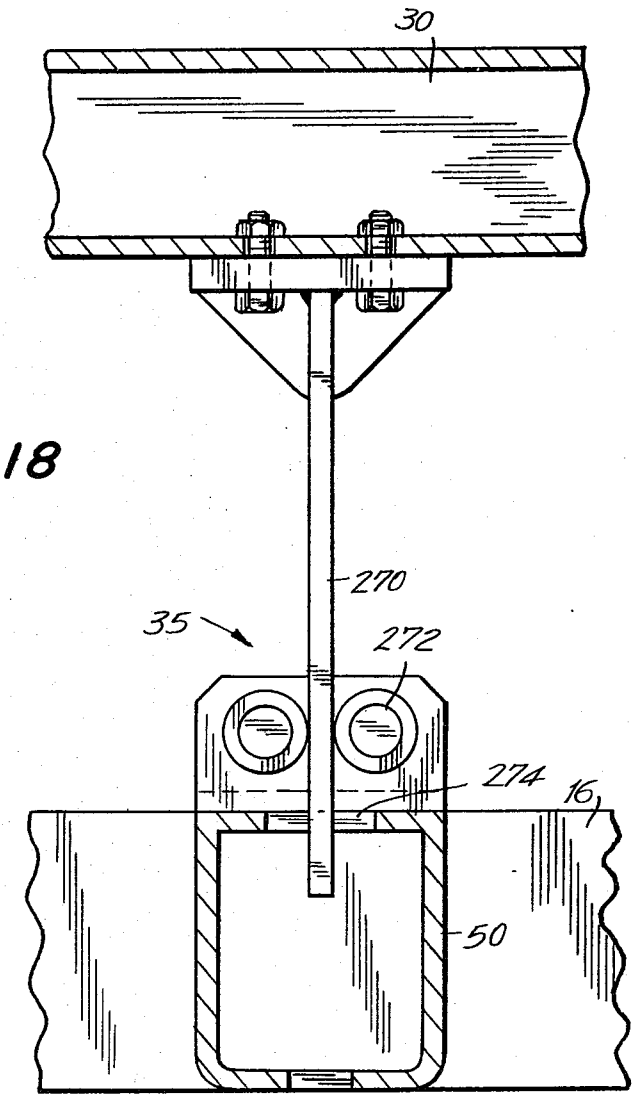
FIG. 18 is a fragmentary sectional elevational view taken along line 18—18 of FIG. 17.

The structure shown in FIG. 13 represents an alternative embodiment to the structure shown in FIG. 7. In FIG. 13 there is provided a modified ram stop lever 241 having a second stop pin 243 positioned thereon. The modified ram stop lever 240 is rotatably secured by the ram stop pivot 154 opposite which is the roller assembly 182. Further and also rotatably secured by the ram stop pivot 154, is an index arm 262 having a hole therein for securing one end of a second extension spring 260. The other end of the second extension spring 260 is secured by an anchor pin 258 that is mounted on the ram stop support 98. In addition, the index arm 262 has a cutout 264 in the center portion of one longitudinal edge thereof. In close proximity to the cutout 264 is a limit switch arm 266. This second embodiment of the double indexing mechanism also provides an idler sprocket 250 that is rotatable mounted on a shaft 251 to one of a pair of the horizontal frame members 128. An index control sprocket 254 having a support collar 257 secured thereto is rotably mounted on a support shaft 252 that is secured to the ram stop support 98. The support collar 257 has an index pin 256 therethrough which is secured by means of a set screw 259. Finally, a sprocket chain 253 engages and is trained about the index control sprocket 254, the idler sprocket 250 and the ram stop sprocket 114.

Figure 17:
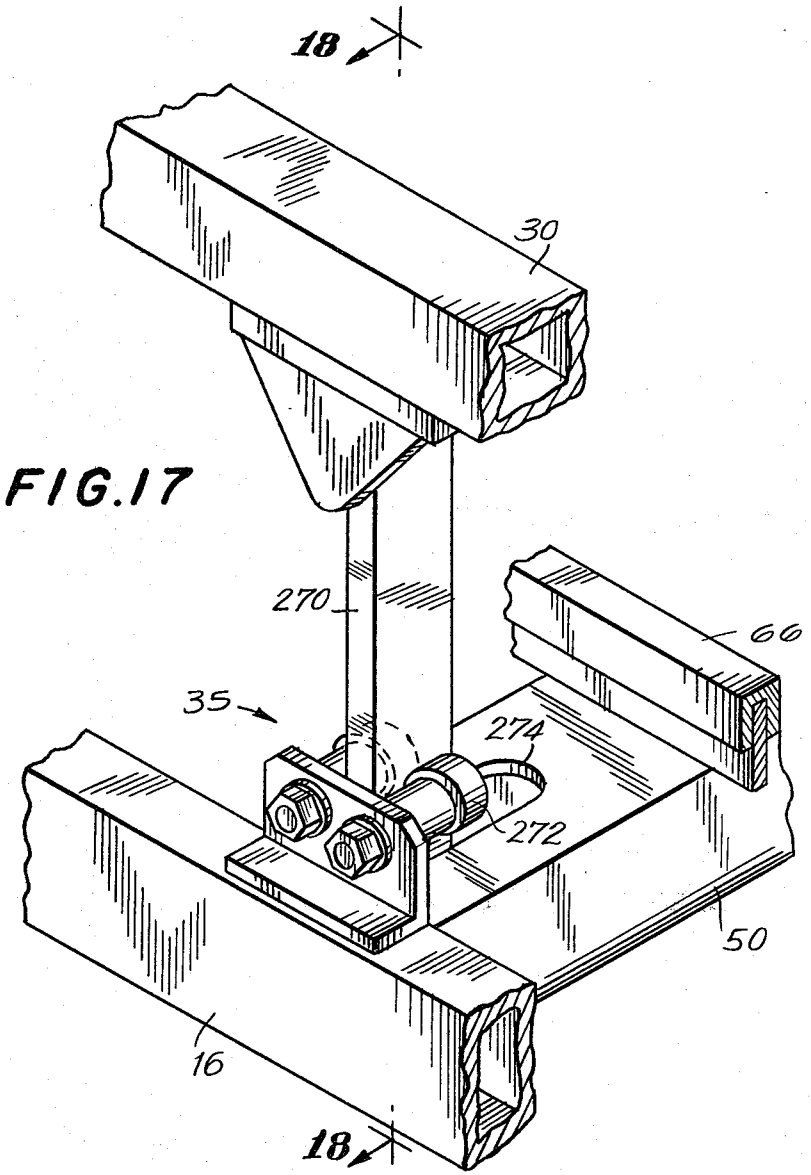
FIG. 17 is a fragmentary perspective view of a slidable alignment mechanism comprising the present invention.

In FIG. 17, there is shown a portion of the screen holder assembly 30 to which is secured a locating member 270 that is restrained from lateral motion by means of a pair of rollers 272 which are secured to the first base frame member 16 by a bracket. A clearance slot 274 is provided in the second base frame member 50.

Figure 19:
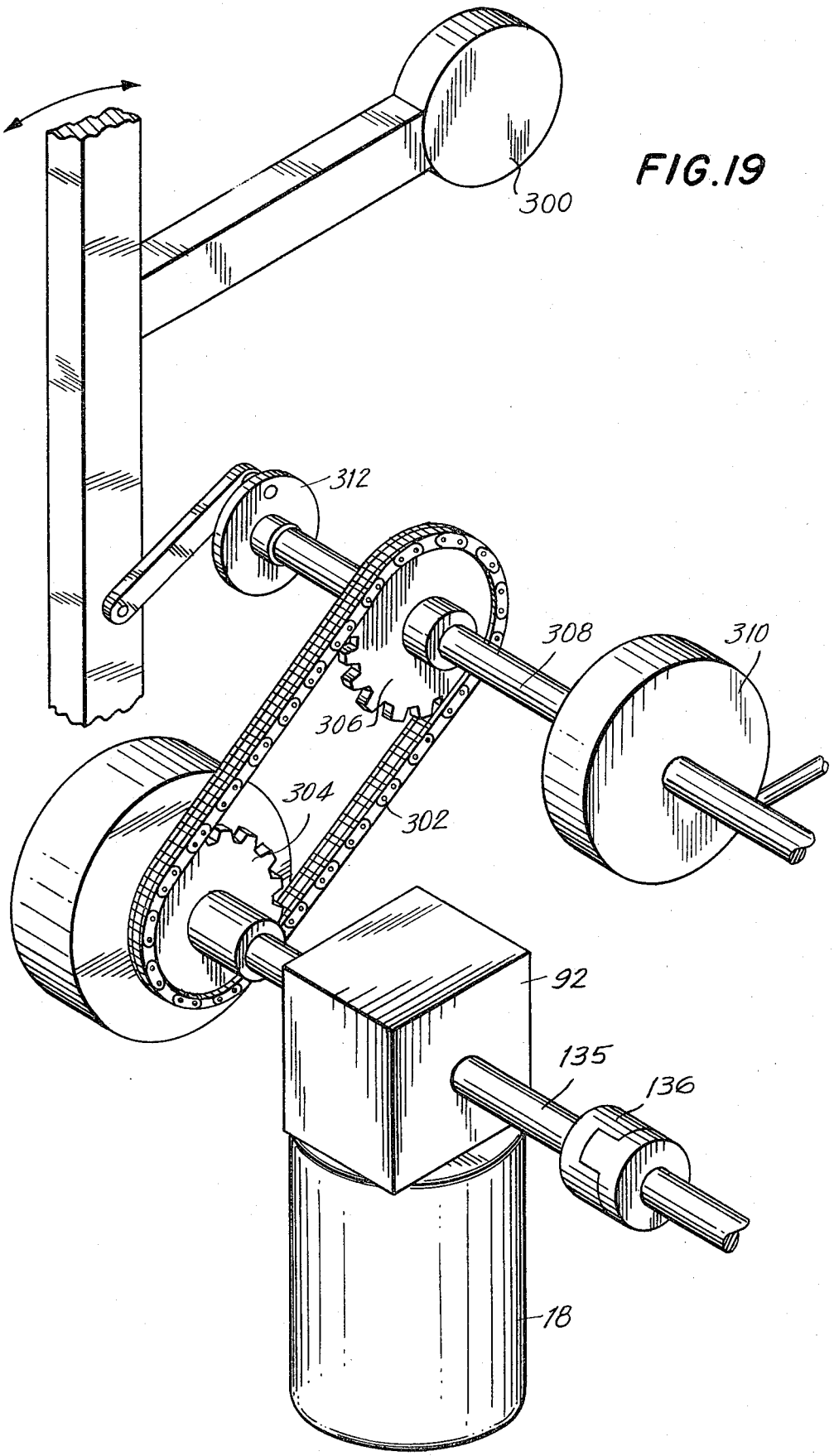
FIG. 19 is a fragmentary, perspective view illustrating a novel brake and counterweight assembly comprising the present invention.

In order to unload the clutch and the brake, a counterweight 300 is provided as shown in FIG. 19. An endless chain 302 is trained about a pair of sprockets 304 and 306. The sprocket 304 is mounted on the shaft 135 so as to be driven by the motor 18 while the sprocket 306 is mounted on a shaft 308 together with a fail safe brake 310 and an eccentric crank arm mechanism 312 which is coupled to the members 116 (FIG. 5) and the counterweight 300 is fastened to members 116, as well.

MODE OF OPERATION

Power for most of the machine is provided by the motor 18 which is directly connected to the right angle gear drive 92 that changes the direction and speed of the motor drive power and, in combination with the coupling 136, drives the first gear box 54 that has two output shafts, one of which drives the frist chain drive assembly 100 and the other of which drives the second chain drive assembly 138.

The second chain drive assembly 138 drives the lift and lower shaft assembly 158 which comprises the lift and lower shaft 135 and a crank arm drive at each end. The lift and lower shaft assembly 58 also provides power to operate the pair of downwardly depending members 116 which are part of the first head assembly 24. The crank arm drive of the lift and lower shaft assembly 58 causes the pair of downward depending members 116 to rotate about the pair of primary pivot pins 48 which are connected to the second base frame assembly 32 that supports the screen printing machine comprising this invention.

The first chain drive assembly 100, shown in FIG. 5, provides power to the first drive shaft 60 which causes the endless chain 20 to traverse its predetermined path. The plurality of pallet assemblies 12 are secured to the endless chain 20 and are provided with a plurality of raised portions 15 thereon. Each pallet assembly 12 is secured to the endless chain 20 by means of pins 10 and 11 with the pin 11 engaging a round hole in its respective pallet assembly 12 and the pin 10 being positioned in an elongated slot in the same pallet assembly 12. This arrangement is described in greater detail in my aforesaid co-pending application. The indexing assembly 56, as shown in FIG. 5, provides an intermittent motion of the first drive shaft 60 and then to the plurality of pallet assemblies 12.

Specifically, FIG. 4 shows the first head assembly 24 in the printing position in solid outline. Shown in dotted outline in FIG. 4 is the out-of-printing position. When the first head assembly 24 is in the printing position a plurality of pull rod assemblies 52 causes a plurality of locator assemblies 34 to lock the pallets 12 which are under the first head assembly 24. The foregoing locking mechanism is also described in my aforesaid co-pending application. Similarly, when the first head assembly 24 is in the out-of-printing position, the locater block 60 of each locater assembly 34 is removed from its respective notch 68.

When the first head assembly 24 is in the printing position, such as shown in FIG. 11, one of the textile workpieces 248 is proximate the top surface of one of the raised portions 15. Immediately on top of the textile workpiece 248 is a screen surface 242. The limit switch 200 and the limit switch 204 are preadjusted so that movement of the plurality of squeegee blades 240 is restricted to the approximate vicinity of the workpiece 248 to the printed since during the printing stroke the screen surface 240 must be supported by the workpiece 248.

The limit switches 200 and 204 are connected to an electrical power source (not shown) which provides power for the sprocket chain 210. During the printing stroke, the second head assembly 26, to which is attached the plurality of squeegee assemblies 42, causes the plurality of squeegee blades 240 to force the ink substance 246 through the screen surface 242 and onto the textile workpiece 248.

Figure 12:
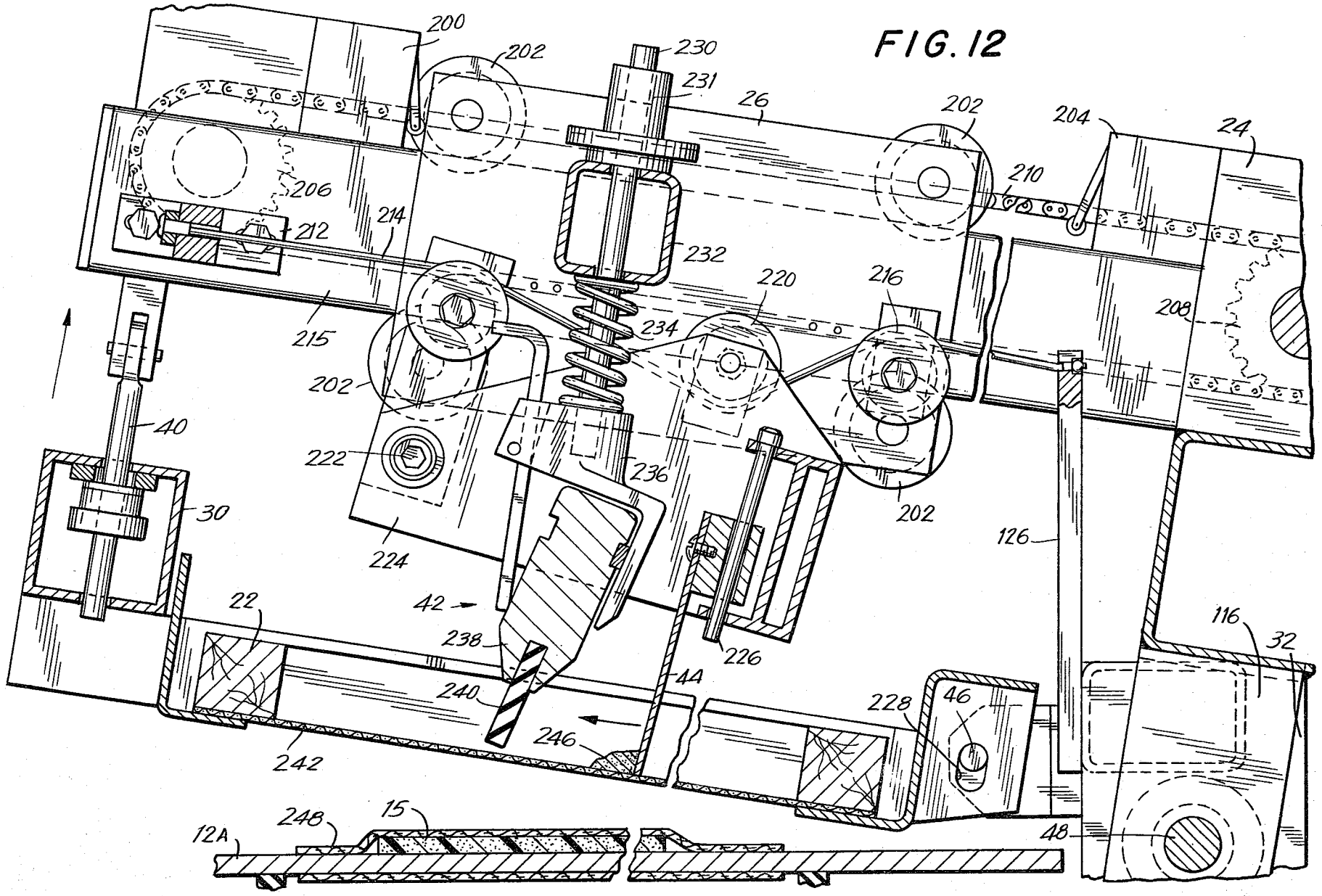
FIG. 12 is a view similar to FIG. 11 but illustrating the structure therein in an alternative position.

When the first head assembly 24 enters the out-of-printing position, a pair of adjustable drag means 40 cause the screen holder assembly 30 to follow the movement of the first head assembly 24. As the screen holder assembly 30 leaves the surface of the textile workpiece 242, it is supported by the pair of screen pivot pins 48 that abut the end of the pair of screen pivot slots 228 as shown in FIG. 12.

In one phase of the printing cycle, the link cables 214 support the flood blade support assembly 224 in such a manner as to prevent the plurality of flood blades 44 from contacting the screen surface 242. In the out-of-printing position, the fixed point of attachment for the link cables 214 and the movable point of attachment for the cable link supports 212 move closer together. This movement allows the flood blade support assembly 224 to rotate about the pivot 222 which also allows the plurality of flood blades 44 to contact the screen surface 242. As the second head assembly 26 moves in the direction of the arrow (FIG. 1), the flood blades 44 collect the ink-like substance 246 and position it for the next printing stroke. In the single indexing embodiment shown in FIG. 7, the downward depending member 116 is in the printing position and the roller assembly 182 has dropped into the first cutout 184 in order to prevent rotation of the ram stop cam 150 and therefore to prevent the movement of the pallet assembly 12.

As an electric logic control signal releases the stop clutch 156, the lift and lower shaft assembly 58 rotates one half of a revolution and then stops. The downward depending member 116 then moves in the direction of the arrow (FIG. 7). The hydraulic damper 112 smoothes out any abrupt movement of the downward depending member 116.

As the downward depending member 116 moves, the ram stop link assembly 148 rotates about the ram stop pivot 154. This movement removes the roller assembly 182 from the first cutout 184 and releases the ram stop cam 150 in order to allow it to rotate in the direction shown by the arrow. Movement of the ram stop assembly 148 also causes the ram stop arm 170 to move closer to the center of the ram stop cam 150. The first ram stop cam pin 180 then strikes the ram stop arm 170 causing the second cutout 186 to move away from the second anchor pin 176. This results in an unlocking action that permits the roller assembly 182 to ride on the periphery of the ram stop cam 150 until it is engaged by the first cutout 184. Subsequently the aforementioned cycle is repeated.

FIG. 13 illustrates the plural indexing mechanism that permits the pallet assemblies 12 to skip at least one printing station, if desired. The chain 253, the index control sprocket 254, the index arm 252 and the modified ram stop lever 240 are added to the single indexing mechanism described previously in connection with FIG. 7 in order to provide the plural indexing mechansim referred to hereinabove. The operation of the ram stop link assembly 148 in the plural indexing mechanism is the same as the single indexing mechanism up to the point where the roller assembly 182 releases the ram stop cam 150. As the first ram stop cam pin 180 strikes the ram stop arm 170, the modified ram stop lever 240 is prevented from moving by the index arm 262 which is urged against the second pin 243 by the index pin 256 that is positioned by the index control sprocket 254. It should be noted that for double indexing, that is the skipping of only one printing station, the index control sprocket 254 rotates once for every two rotations of the ram stop sprocket 114. Therefore, indexing of the pallet assemblies 12 is prohibited for every pivotal displacement of the ram stop sprocket arm 170. The modified ram stop lever and the first ram stop cam pin 180 strikes the ram stop arm 170, the modified ram stop lever 240 is prevented from moving by the index arm 262 which is urged against the second stop pin 243 by the index pin 256 that is positioned by the index control sprocket 254.

The limit switch 266 provides the control signal which prevents the first head assembly 24 from entering the printing position during double indexing. It is an important feature of the present invention that the double indexing mechanism described hereinabove, and illustrated in FIG. 13, can be adjusted for single indexing by withdrawing the index pin 256 from contact with the index arm 262. The index pin 256 can be fixed in either mode of operation by using the set screw 259.

Thus, there is disclosed in the above description and in the drawings, the embodiments of the present invention which fully and effectively accomplish the objects hereof. However, it will be readily apparent to those skilled in the art that there are many variations, modifications, and changes which may be made in the present invention without departing from the spirit, scope and teachings hereof.

Therefore, this invention is not to be limited by the specific disclosure herein but only by the appended claims.

I claim:

1. A screen printing machine having a plurality of adjacent printing stations, said screen printing machine comprising:

a supporting frame, a rail mounted on said supporting frame, a plurality of pallet assemblies spaced from said rail, a drive means including a motor for operatively interconnecting and displacing said pallet assemblies along a path defined by said rail, a printing head mounted on said frame for movement between an operative printing position at each of the printing stations and an inoperative non-printing position spaced from each of said printing stations, means for selectively indexing said pallet assemblies to successive printing stations and stations separated by at least one intermediate printing station, said means for selectively indexing said pallet assemblies between successive and spaced apart printing stations comprising:

a ram stop cam driven by said motor, said ram stop cam having a single notch in the periphery thereof, a ram stop link assembly responsive to the movement of said printing head between said printing position and said non-printing position, a ram stop lever pivotally mounted on said ram stop link assembly, and a cam follower mounted on said ram stop lever and positioned to selectively engage said notch in the ram stop cam periphery, first and second stop means integral with said ram stop cam and said ram stop lever, respectively, for engaging first and second portions of said ram stop link assembly, third stop means on said ram stop link for displacing said pallet assemblies at least two positions, an index arm pivotally mounted on said ram stop link assembly, an index control sprocket, a second sprocket coupled to and rotatable with said cam stop cam, said index control sprocket being larger in diameter than said second sprocket by an integer that determines the spacing between which said pallet assemblies are indexed, a chain trained about said first and said second sprockets, an index pin selectively positionable in said first sprocket for rotation therewith, and said index pin being positionable to engage and displace said index arm whereby said index arm engages said third stop means and angularly displaces said ram stop lever and said pallet assemblies are displaced at least two positions.

2. A screen printing machine in accordance with claim 1, wherein said printing head means includes, a head frame pivotally mounted on said supporting frame means, a carriage movably mounted on said head frame, a squeegee means mounted on said carriage, and a screen holder disposed in spaced relation to said carriage and said squeegee means mounted thereon, said screen holder having two ends, one of which is pivotally mounted to said supporting frame means, a connecting link supporting the other end of said screen holder with respect to said head frame, and means on said link connected end of said screen holder for effecting a predetermined amount of lost motion between said head frame and carriage mounted thereon and said screen holder as said printing head is pivoted between an operative printing position and an inoperative non-printing position.

3. A screen printing machine in accordance with claim 2, including a floodbar mounted on said carriage, means for biasing said floodbar towards an operative flooding position concomitantly with a non-printing position of said head means, and means for overcoming said bias of said floodbar in said printing position of said head.

4. A screen printing machine in accordance with claim 3, wherein said flood bar is removably mounted on said carriage, said means for biasing said flood bar towards a printing screen is a spring, and said means for overcoming the bias of said flood bar biasing means in the printing position of the head assembly is operatively connected to said flood bar.

5. A screen printing machine in accordance with claim 4, wherein said operative connecting means includes a flood roller connected to said flood bar, a flood bar bridge supported below side rails of said head frame, and said flood roller being disposed in rolling engagement with said flood bar bridge in the printing position of said head assembly for maintaining the associated flood bar removed from the printing screen in the printing position.

6. A screen printing machine in accordance with claim 1, wherein said index pin is removable.

7. A screen printing machine in accordance with claim 1, wherein said index pin is disposed in a ridigly fixed position.

8. A screen printing machine in accordance with claim 1, wherein said index control sprocket is substantially twice the size of said second sprocket.

* * * * *